US006866249B1

(12) United States Patent
Campbell et al.

(10) Patent No.: US 6,866,249 B1
(45) Date of Patent: Mar. 15, 2005

(54) B-POST EXTENSION DEVICE

(76) Inventors: Shane Campbell, 5721 Valley Way, Oklahoma City, OK (US) 73150; Alan Sanders, 4722 N. Henney Rd., Choctaw, OK (US) 73020

( * ) Notice: Subject to any disclaimer, the term of this patent is extended or adjusted under 35 U.S.C. 154(b) by 75 days.

(21) Appl. No.: 10/736,659

(22) Filed: Dec. 16, 2003

Related U.S. Application Data

(60) Provisional application No. 60/436,211, filed on Dec. 23, 2002.

(51) Int. Cl.[7] ..... B66F 3/24

(52) U.S. Cl. ..... 254/93 R; 254/133 R; 254/134; 254/104

(58) Field of Search ..... 254/93 R, 134, 254/133 R, 1, 49, 104, DIG. 1; 269/43

(56) References Cited

U.S. PATENT DOCUMENTS

| | | | | |
|---|---|---|---|---|
| 4,762,304 A | * | 8/1988 | Hill | 254/93 R |
| 5,267,462 A | * | 12/1993 | Pijanowski | 72/392 |
| 5,330,167 A | * | 7/1994 | Plumb | 269/43 |
| 5,651,417 A | | 7/1997 | Coughlin | |
| 5,810,333 A | * | 9/1998 | Hickerson et al. | 254/93 R |
| 6,272,900 B1 | | 8/2001 | Kobel | |
| 6,431,522 B1 | * | 8/2002 | Cutrell et al. | 254/1 |

OTHER PUBLICATIONS

Holmatro Rescue Equipment; Chocks, Blocks and Wedges http://products.holmatro–usa.com/family.asp?fid=sp8.

Holmatro Rescue Equipment; Ram Support http://products.holmatro–usa.com/familydetails.asp?fid=sp9.

Rocker Panel Support http://www.art4rescue.com/Tools/name/Rockerpanelsupport.htm.

Rescuetoolman.com, Rocker Support Panel #33 http://www.rescuetoolman.com/onlinestore/customer/product.php?productid=33&cat=22.

* cited by examiner

*Primary Examiner*—Lee D. Wilson
(74) *Attorney, Agent, or Firm*—Ronald D. Homburg

(57) ABSTRACT

The B-post extension device is a movable support base utilized in emergency rescue situations involving automobiles, specifically door openings, the device providing for an adjustable support base for an extension ram, the device being placed against a support structure within the automobile, the device further having an adjustable slide plate secured upon at least two support rod arms, the support rod arms spanning a distance between a heel portion and a toe portion, the toe and heel portion resting against the automobile support structure, reducing the distance required to be pushed by the extension ram and providing readjustment for the increasing span of the door opening during extension and recovery of the extension ram.

4 Claims, 6 Drawing Sheets

B-POST EXTENSION DEVICE

CROSS REFERENCE TO RELATED APPLICATIONS

Provisional Patent Application No. 60/436,211 filed Dec. 23, 2002.

I. BACKGROUND OF INVENTION

1. Field of the Invention

The B-post extension device is a movable support base utilized in emergency rescue situations involving automobiles, specifically door openings, the device providing for an adjustable support base for an extension ram, the device being placed against a support structure within the automobile, the device further having an adjustable slide plate secured upon at least two support rod arms, the support rod arms spanning a distance between a heel portion and a toe portion, the toe and heel portion resting against the automobile support structure, reducing the distance required to be pushed by the extension ram and providing readjustment for the increasing span of the door opening during extension and recovery of the extension ram.

2. Description of Prior Art

The following United States patents are identified and disclosed herein. Several devices are disclosed relating to extension ram accessories. Little prior art was discovered currently held under patents, but several products sharing similar use and function as the extension device were found on sale on the Internet.

One prior art device, U.S. Pat. No. 6,431,522 to Cutrell, Sr. included a clamping base for an extension ram used to urge open a collapsed doorway of an automobile after a collision. U.S. Pat. No. 6,272,900 to Kobel included a tip which is placed on the end of an extension ram to prevent slippage of the ram tip. U.S. Pat. No. 5,651,417 to Coughlin disclosed a base mounted as an anchor for a fire fighting tool on a ship which was intended to dig into a bulkhead and secure a high pressure firefighting device. An entire portable rescue device which included the hydraulic ram and an expandable frame was disclosed in U.S. Pat. No. 5,267,462 to Pujanowski.

More relative to the field of endeavor of the extension device of the current invention were those tools found on in the Internet search. A set of chocks, blocks and wedges are shown, for sale by Holmatro Rescue Equipment, as well as a ram support also found on their Internet catalogue pages. Another design product entitled "Rocker Panel Ram Support" made by American Rescue Technology for sale by Genesis Rescue Systems was located which is used with a ram to provide a plurality of stationary base points to buttress and extension ram. Rescuetoolman.com also had a Rocker Panel Support #33 which performs a similar function as the current device, although providing only a few stationary support bases.

None of these rocker panel supports or wedge basis provide any adjustable means allowing for the precision setting of the extension ram support to the ram as opposed to requiring the setting of the ram to the extension ram support.

II. SUMMARY OF THE INVENTION

In emergency rescue operations involving automobile accidents, it is often necessary to force parts of the damaged automobile apart, increase openings, create openings or remove certain damaged structural components of the automobile to extract passengers from the interior of the automobile or to alter the damaged automobile to facilitate transport by wrecker. When this occurs, use of an extension ram or other forcing device that provides force in opposing directions is commonly used. In the past, certain items, including support chocks or stepped base supports, are commonly employed to provide the extension ram or hydraulic piston with a base having multiple attaching points which allow for the extension ram to be moved along the chocks or supports so that as the opening or subject components are moved apart, the chock or support allows for repositioning of the extension ram base along the stationary chock or support.

The problem encountered with the prior art (Page 1 of 3 of the drawings) is that the chocks or supports of the past provided engagement points at only certain points which require the extension ram to be of a suitable length to fit the location on the chock or support available. In other words, the ram has to be adjusted to the chock or support. The present device shifts the adjustment to the device instead of the extension ram.

Once the device of the present invention is placed, the sliding plate, providing the support to the base of the extension ram, may be slid along the two or more slide rod supports and positioned at any location along the slide rod supports necessary to accommodate the extension ram base location during the extension process, the sliding plate secured to the slide rod supports by a simple tilt, locking the sliding plate to the slide rod supports, while the heel portion of the device is secured against a support structure of the automobile, which is commonly the B-post of the automobile to force the front door opening of the vehicle open to extract the automobile passengers.

III. DESCRIPTION OF THE DRAWINGS

The following drawings are informal drawings submitted with this provisional patent application.

FIG. 6 is a front surface view of the heel portion.

FIG. 9 is a side view of the B-post extension device being applied to an automobile door opening.

IV. DESCRIPTION OF THE PREFERRED EMBODIMENT

Figure 1:
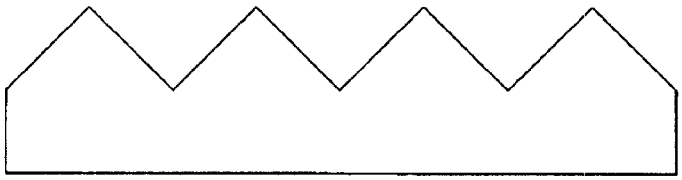
FIG. 1 PRIOR ART
FIG. 1 is a drawing of a prior art B-post extension block.

The B-post extension device 10, shown in FIGS. 3–9 of the drawings, is an adjustable support brace used in conjunction with a power extension ram 100 having a ram base 110 and ram tip 120, the device 10 providing an adjustable support for forcing portions of a damaged automobile 200 apart for extraction of a victim or for bending other portions of the damaged automobile 200 for other purposes, the device 10 comprising essentially a heel portion 20 having a handle 25, a toe portion 30, at least two slide bar arms 40*a*, 40*b* positioned parallel attached between the heel portion 20 and toe portion 30 and a sliding plate 50 having holes 51 slidably engaged with the slide bar arms 40*a*, 40*b*, the sliding plate 50 having a bracing bar 55 attached to a front surface 56 of the sliding plate 50 to support the base 110 of an extension ram 100.

Figure 2:
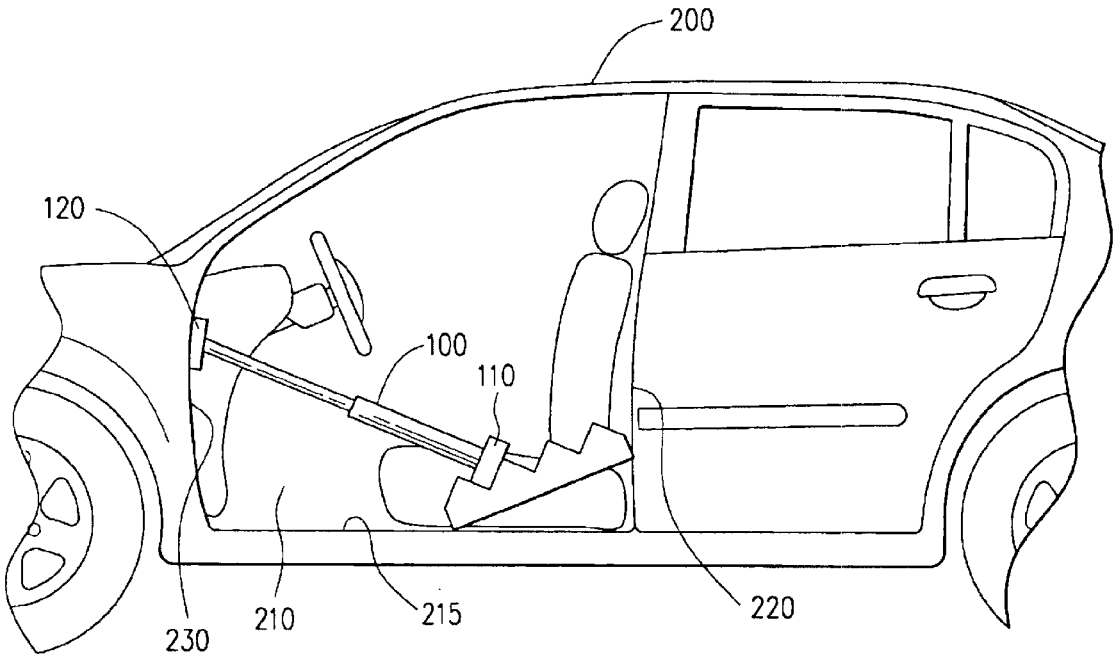
FIG. 2 PRIOR ART
FIG. 2 is a drawing of the prior B-post extension block being applied to an automobile door opening.
Figure 3:
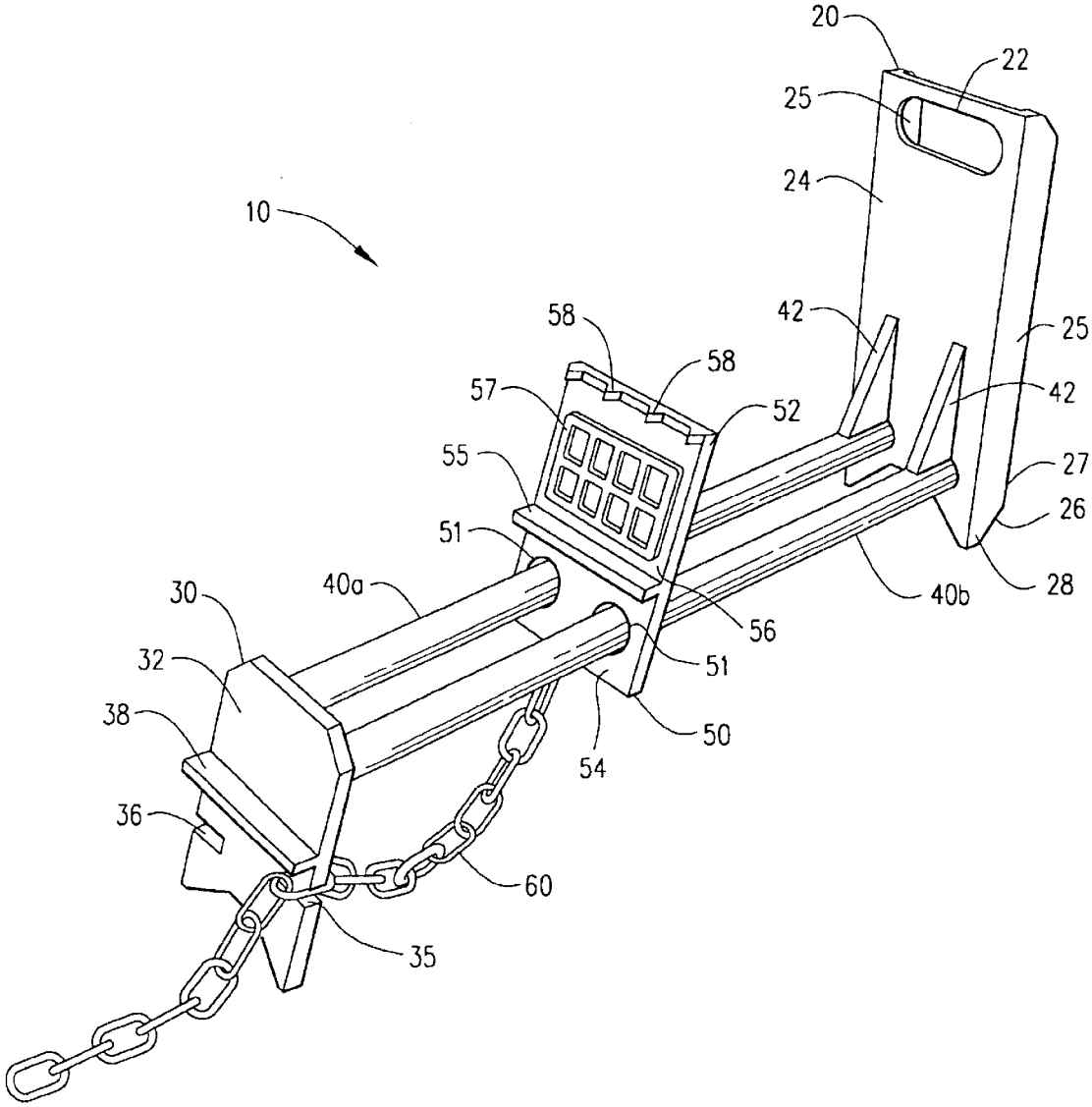
FIG. 3 is a front perspective view of the current B-post extension device.
Figure 4:
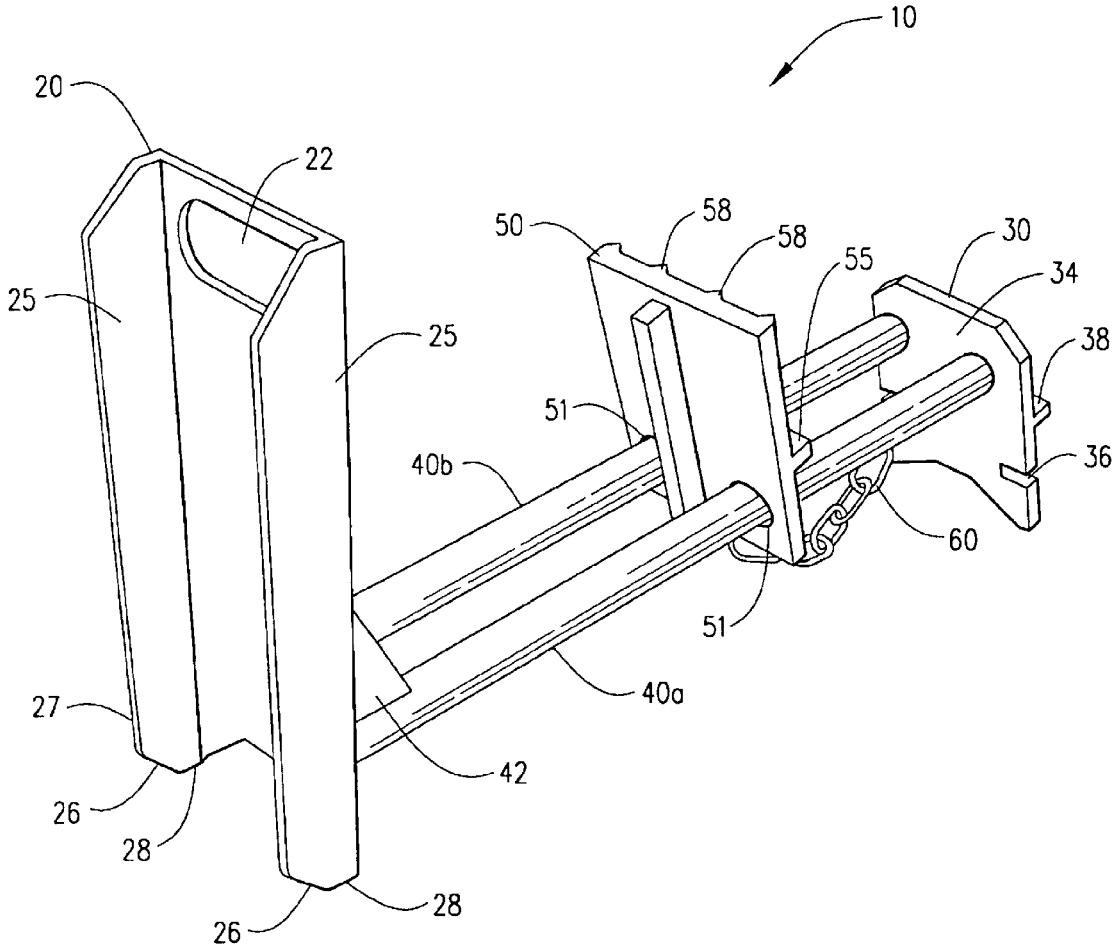
FIG. 4 is a rear perspective view of the B-post extension device.
Figure 3:
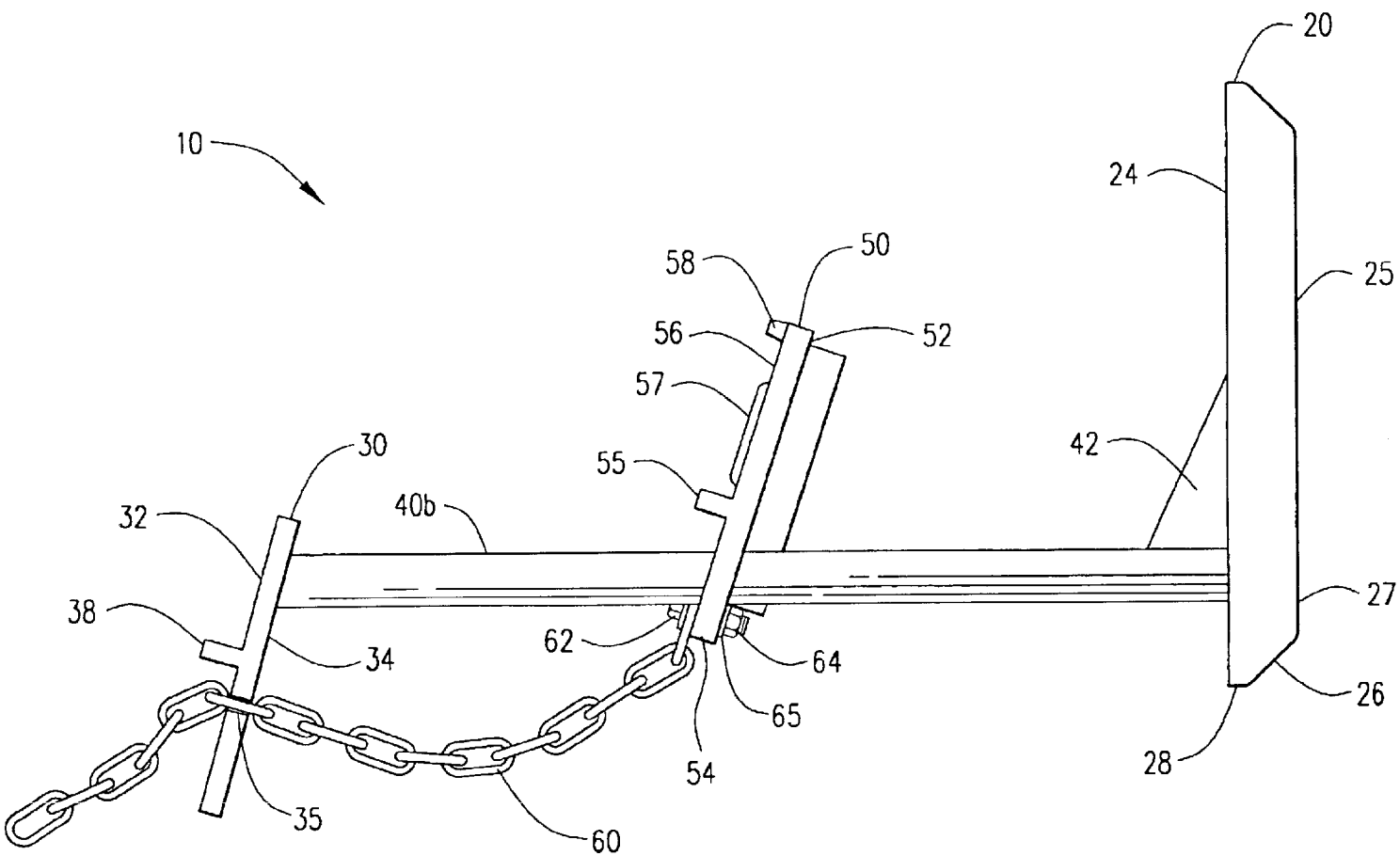

Prior art devices, shown in FIGS. 1 and 2 of the drawings, show a prior used block device indicating a stepped support base placed in a door opening of an automobile providing multiple progressive engaging surfaces for an extension ram to allow for a progressive pushing surface for the extension ram, the prior art device shown abutted against a B-post of an automobile.

More specifically, as shown in FIGS. 3–9, the B-post extension device 10 which is the subject of the present invention, includes the heel portion 20 being a section of high strength metal channel having a front surface 22, a rear surface 23 and two side portions 24, the side portions 24 being rectangular and having a lower end 27, with a bevel 26 at each lower end 27 forming support legs 28, as shown in FIGS. 3–6 of the drawings. The handle 25 is positioned on the front surface 22, shown in FIG. 6 as an oval hole.

The toe portion 30 of the device, shown in FIGS. 3–5 and 8 of the drawings, is a rectangular piece of flat high strength metal having a front surface 32 and rear surface 34, the front surface 32 including a support ridge 38 provided as a secondary support for the base 110 of the extension ram 100 or other forcing tool.

Figure 5:
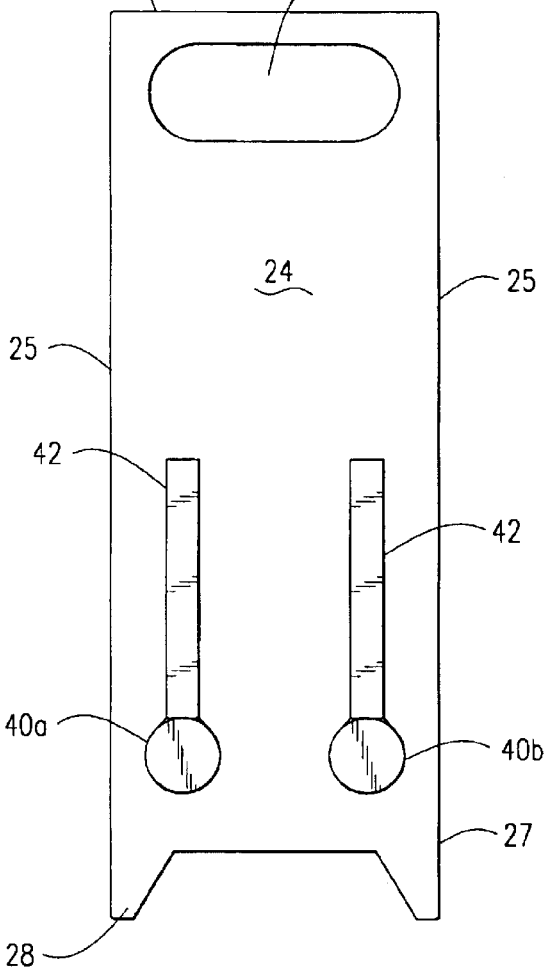
FIG. 5 is a side view of the B-post extension device.
Figure 7:
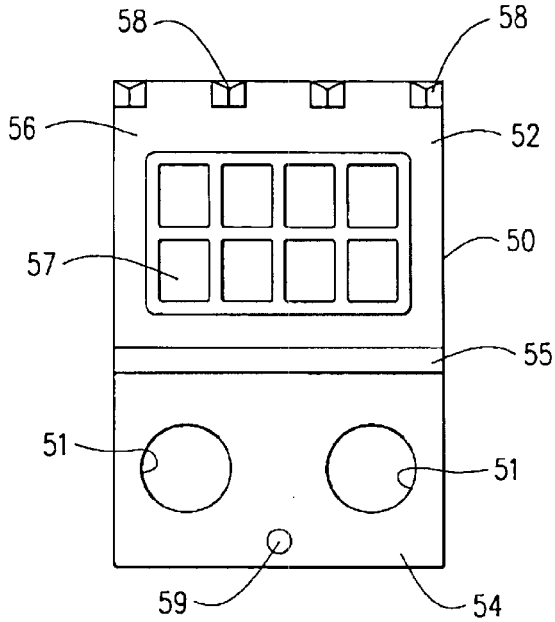
FIG. 7 is a front surface view of the sliding plate.
Figure 8:
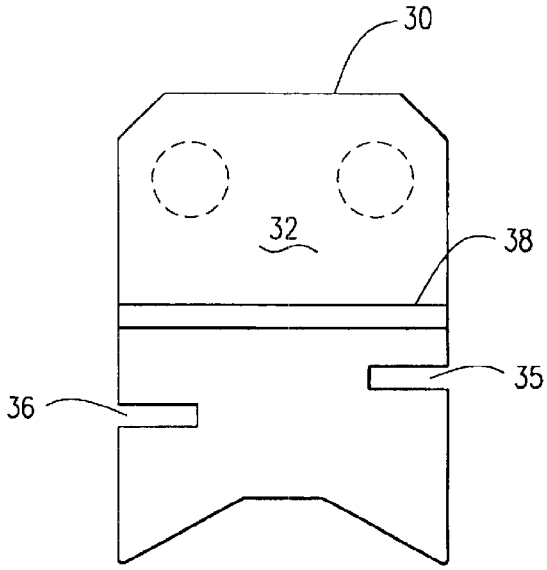
FIG. 8 is a rear surface view of the toe portion.
Figure 3:
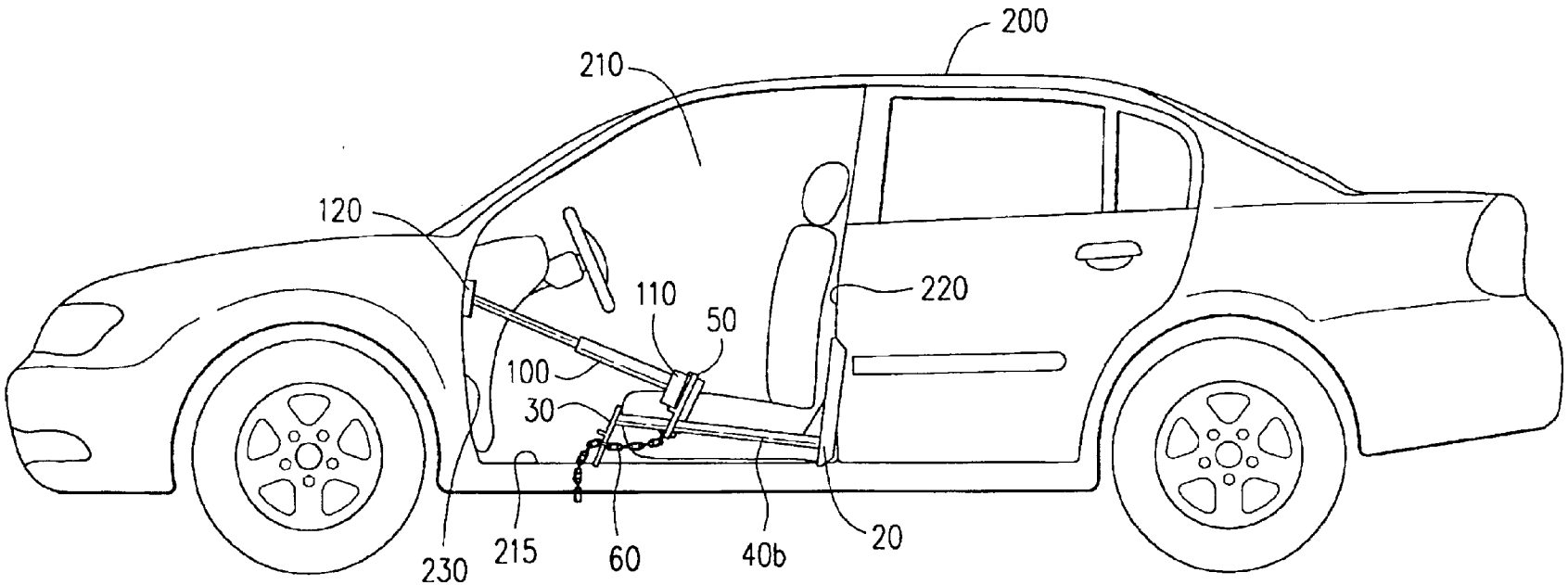

In the drawings, the device is shown to have two slide bar arms 40*a*, 40*b*. These at least two slide bar arms 40*a* and 40*b* are required for the device to function as intended. The two slide bar arms 40*a*, 40*b* are welded in parallel between the rear surface 34 of the toe portion 30 and the front surface 22 of the heel portion 20 in a relatively horizontal plane, with the toe portion 30 and heel portion 20 in a relatively vertical plane, slightly tilted back, as indicated in FIG. 5, as a preferred embodiment. Reenforcement angle braces 42 are placed where the slide bar arms 40*a*, 40*b* are attached to the front surface 22 of the heel portion 20, to reenforce the attachment of the slide bar arms 40*a*, 40*b*.

Prior to the attachment of the heel portion 20 and toe portion 30 to the slide bar arms 40*a*, 40*b*, the sliding plate 50, FIGS. 3–5 and 7, is slidably engaged with the slide bar arms 40*a*, 40*b*, the holes 51 of the sliding plate 50 slightly larger than the diameter of the slide bar arms 40*a*, 40*b*. The holes 51 in the sliding plate 50 should be a smooth bore with sharp edges. The bracing bar 55 runs across a front surface 56 of the sliding plate 50 and supports the base 110 of the extension ram 100, placing the greater amount of force of the extension ram on the upper portion of the sliding plate. With this engagement, the sliding plate 50 moves freely along the slide bar arms 40*a*, 40*b* when the sliding plate 50 is perpendicular to the slide bar arms 40*a*, 40*b*, but locks along the slide bar arms 40*a*, 40*b* when tilted back, providing a secure anchor point for the base 110 of the extension ram 100, as shown in FIGS. 3–5 and 9 of the drawings.

The sliding plate 50 further comprises an upper end 52, a lower end 54, with the front surface 56 having a waffled section 57 providing additional friction to the front surface 56 to reduce disengagement of the ram base 110 from the front surface 56 during use of the device 10 with an extension ram 100. The upper end 52 of the sliding plate 50 also includes a plurality of serrated teeth 58 directed away from the front surface 56 allowing the sliding plate 50 to be used to grip a surface with the sliding plate 50 with some degree of penetration and enhanced contact. The lower end 54 of the sliding plate 50 includes an anchor bolt hole 59 within which may be attached a safety chain 60 to secondarily secure the sliding plate 50 during use with the extension ram 100 or otherwise. The safety chain is attached to the anchor bolt hole by an anchor bolt 62, and anchor washer 65 and an anchor nut 64.

The toe portion 30 further has a first chain slot 35 and a second chain slot 36 which allow for the attachment of the safety chain 60, already secured to the sliding plate 50 to prevent movement of the sliding plate 50 or accidental disengagement of the sliding plate 50 from the slide bar arms 40*a*, 40*b* during use with the extension ram 100 or during other use of the device 10.

It is also contemplated within the scope of this device, although not shown in any drawings nor included within any claims, that the device may be provided in alternative embodiments, wherein the device includes at least one solid square rod in place of the round slide rods disclosed in the preferred embodiment, with a corresponding shaped opening in the sliding plate slightly larger than the solid square rod. More than one square rod may be used with multiple lightly larger square opening in the sliding plate. One may also choose to align holes along the length of the square rod within which is places a removable locking safety pin to prevent full disengagement of the sliding plate along the square rod.

Use of the device 10 with an extension ram 100 for a rescue operation by qualified emergency rescue personnel to force open a door opening 210 of an automobile 200, demonstrated in FIG. 9 of the drawings, involves, most importantly, the secure placement of the device 10 within the door opening 210 by abutting the bevels 26 of the side portions 24 and the rear surface 23 of the heel portion 20 of the device 10 against a B-post 220 of the door opening 210, abutting the toe portion 30 against a lower door frame 215, applying the ram base 210 to the waffled section 57 of the front surface 56 of the sliding plate 50, positioning the sliding plate 50 along the two slide bar arms 40*a*, 40*b* until the ram tip 120 is against an A-post 230 of the door opening 210 at a preferred location, attaching the safety chain 60 within the first chain slot 35 or second chain slot 36 as desired, insuring that little slack is left in the safety chain 60, locking the sliding plate 50 along the slide bar arms 40*a*, 40*b* by the tilt force applied from the placement of the ram base 210 above the bracing bar 55 on the front surface 56 of the sliding plate 50, activating the extension ram 100 forcing the ram base 110 and the ram tip 120 apart until at full extension, retracting the extension ram 100, disengaging the safety chain 60 from the first chain slot 35 or second chain slot 36, sliding the sliding plate 50 forward towards the toe portion 30 until the collapsed extension ram 100 has the ram tip 120 against the A-post 230 and the ram base 110 is against the front surface 56 of the sliding plate 50 above the bracing bar 55, engaging the safety chain 60 within the first chain slot 35 or second chain slot 36, and again forcing the extension ram base 110 away from the extension ram tip 120, each cycle of use forcing the A-post 230 away from the B-post 220 enlarging the door opening 210 of the automobile 200 until emergency rescue access is achieved.

Although the embodiments of the invention have been described and shown above, it will be appreciated by those skilled in the art that numerous modifications and alterations may be made therein without departing from the scope of the invention as herein described. It will also be obvious to those skilled in emergency rescue that the B-post extension device 10 may have uses in emergency rescue not specified in this patent application, but which would be utilized with a proper degree of care and safety for other emergency rescue needs including use as a brace or support in a vertical plane or a horizontal plane, use as a manual jack base, used in conjunction with a jack as an upwardly adjusting secure stand, the sliding plate 50 being lifted upward and locked as the jack lifts an object.

We claim:

1. A B-post extension device providing an adjustable support brace for forcing portions of a door opening of a damaged automobile apart for extraction of a victim or for bending other portions of the damaged automobile for other purposes used in conjunction with a power extension ram having a ram base and ram tip, the device comprising:

a heel portion having a handle, said heel portion further having a front surface, a rear surface and two side portions, said side portions having a lower end with a bevel at each lower end forming support legs;

a toe portion having a front surface and rear surface, said front surface including a support ridge;

at least two slide bar arms positioned in parallel and attached between said heel portion and said toe portion, said two slide bar arms are welded in parallel between said rear surface of said toe portion and said front surface of said heel portion with reenforcement angle braces also attached to said supporting said slide bar arms and said front surface of said heel portion; and a sliding plate having holes slidably engaged with the slide bar arms, said sliding plate having a bracing bar attached to a front surface of said sliding plate to support said ram base of said extension ram when said ram tip is forcibly applied against said door opening of said damaged automobile, said holes of said sliding plate slightly larger than said slide bar arms, said bracing bar traversing a front surface of said sliding plate, said sliding plate moving freely along said slide bar arms when said sliding plate is perpendicular to said slide bar arms, but locking along said slide bar arms when tilted back, said sliding plate further comprising an upper end, a lower end, a waffled section on said front surface above said bracing bar, said upper end having a plurality of serrated teeth directed away from said front surface.

2. A B-post extension device providing an adjustable support brace for forcing portions of a door opening of a damaged automobile apart for extraction of a victim or for bending other portions of the damaged automobile for other purposes used in conjunction with a power extension ram having a ram base and ram tip, the device comprising:

a heel portion having a handle, said heel portion further having a front surface, a rear surface and two side portions, said side portions having a lower end with a bevel at each lower end forming support legs;

a toe portion having a front surface and rear surface, said front surface including a support ridge;

at least two slide bar arms positioned in parallel and attached between said heel portion and said toe portion, said two slide bar arms are welded in parallel between said rear surface of said toe portion and said front surface of said heel portion with reenforcement angle braces also attached to said supporting said slide bar arms and said front surface of said heel portion; and a sliding plate having holes slidably engaged with the slide bar arms, said sliding plate having a bracing bar attached to a front surface of said sliding plate to support said ram base of said extension ram when said ram tip is forcibly applied against said door opening of said damaged automobile, said holes of said sliding plate slightly larger than said slide bar arms, said bracing bar traversing a front surface of said sliding plate, said sliding plate moving freely along said slide bar arms when said sliding plate is perpendicular to said slide bar arms, but locking along said slide bar arms when tilted back, said sliding plate further comprising an upper end, a lower end, a waffled section on said front surface above said bracing bar, said upper end having a plurality of serrated teeth directed away from said front surface, said lower end of said sliding plate including an anchor bolt hole within which may be attached a safety chain to secondarily secure said sliding plate, said safety chain attached to said anchor bolt hole by an anchor bolt, an anchor washer and an anchor nut, with said safety chain being inserted within said first chain slot or said second chain slot, secondarily locking said sliding plate.

3. A B-post extension device providing an adjustable support brace for forcing portions of a door opening of a damaged automobile apart for extraction of a victim or for bending other portions of the damaged automobile for other purposes used in conjunction with a power extension ram having a ram base and ram tip, the device comprising:

a heel portion having a front surface, a rear surface and two side portions, said side portions having a lower end with a bevel at each lower end forming support legs;

a toe portion having a front surface, a rear surface, a first chain engaging slot and a second chain engaging slot, said front surface including a support ridge;

at least two slide bar arms welded in parallel between said rear surface of said toe portion and said front surface of said heel portion with reenforcement angle braces also attached to said supporting said slide bar arms and said front surface of said heel portion; and a sliding plate slidably engaged with said slide bar arms, said holes of said sliding plate slightly larger than said slide bar arms, said bracing bar traversing a front surface of said sliding plate, said sliding plate moving freely along said slide bar arms when said sliding plate is perpendicular to said slide bar arms, but locking along said slide bar arms when tilted back, said sliding plate further comprising an upper end, a lower end, a waffled section on said front surface above said bracing bar, said upper end having a plurality of serrated teeth directed away from said front surface, said lower end of said sliding plate including an anchor bolt hole within which may be attached a safety chain to secondarily secure said sliding plate, said safety chain attached to said anchor bolt hole by an anchor bolt, an anchor washer and an anchor nut, with said safety chain being inserted within said first chain slot or said second chain slot, secondarily locking said sliding plate.

4. A method of using the device as disclosed in claim 3, said method, intended for rescue operation by qualified emergency rescue personnel, comprising the steps of:

securely placing of said device within said door opening of said automobile by abutting said bevels of said side portions and said rear surface of said heel portion of said device against a B-post of said door opening and abutting said toe portion against a lower door frame;

applying said ram base to said waffled section of said front surface of said sliding plate;

positioning said sliding plate along said two slide bar arms until said ram tip is against an A-post of said door opening of said automobile at a preferred location;

attaching said safety chain within either said first chain slot or second chain slot, with little slack in said safety chain;

locking said sliding plate along said slide bar arms by said tilt force applied from placement of said ram base above said bracing bar on said front surface of said sliding plate;

activating said extension ram, forcing said ram base and said ram tip apart until at full said extension ram;

disengaging said safety chain from said first chain slot or second chain slot;

sliding said sliding plate forward towards said toe portion until said collapsed extension ram has said ram tip against said A-post and said ram base is against said front surface of said sliding plate above said bracing bar;

re-engaging said safety chain within either said first chain slot or second chain slot;

again forcing said extension ram base away from said extension ram tip; and repeating said extension and retracting said extension ram and adjusting said sliding plate along said slide bar arms until said door opening is wide enough to complete rescue.

* * * * *